US005378123A

United States Patent [19]

Scuderi et al.

[11] Patent Number: 5,378,123

[45] Date of Patent: Jan. 3, 1995

[54] APPARATUS FOR RECOVERING REFRIGERANT WITH OFFSET CAM

[75] Inventors: Carmelo J. Scuderi, 173 Prospect St., Springfield, Mass. 01107; Charles K. Forner, Longmeadow, Mass.

[73] Assignee: Carmelo J. Scuderi, Springfield, Mass.

[21] Appl. No.: 930,156

[22] Filed: Aug. 14, 1992

Related U.S. Application Data

[60] Division of Ser. No. 778,734, Oct. 18, 1991, abandoned, which is a continuation-in-part of Ser. No. 551,936, Jul. 12, 1990, abandoned, which is a division of Ser. No. 474,925, Feb. 2, 1990, Pat. No. 4,981,020.

[51] Int. Cl.[6] ..... F04B 17/00

[52] U.S. Cl. ..... 417/415; 92/240

[58] Field of Search ..... 417/415; 92/240, 243, 92/248, 172, 187; 277/165, 176, 177, 58, 158

[56] References Cited

U.S. PATENT DOCUMENTS

| | | | |
|---|---|---|---|
| 4,831,918 | 5/1989 | Mieke et al. | 92/187 |
| 4,848,213 | 7/1989 | Wood et al. | 92/172 |
| 4,928,578 | 5/1990 | Rhodes | 92/187 |
| 5,033,941 | 7/1991 | Jensen | 417/415 |
| 5,111,737 | 5/1992 | Dormer et al. | 92/187 |
| 5,113,747 | 5/1992 | Pignerol | 277/165 |
| 5,116,206 | 5/1992 | Adahan | 92/240 |

OTHER PUBLICATIONS

Parker–PTFE–Feb. 1989.
Parker–PPD3700–Aug. 1989.

*Primary Examiner*—Richard A. Bertsch
*Assistant Examiner*—Alfred Basichas
*Attorney, Agent, or Firm*—Fishman, Dionne & Cantor

[57] ABSTRACT

An apparatus for recovering a compressible refrigeration fluid from a refrigeration system and delivering the recovered fluid to a receiver includes a discriminator tank for discriminating between influent liquid phase fluid and gas phase fluid. Liquid phase fluid is directed to the receiver. Gas phase fluid is condensed and directed to the receiver. The apparatus further includes a safety tank for preventing overfilling of the receiver and a lightweight compressor particularly adapted to refrigerant recovery. The lightweight compressor includes self lubricating bidirectional seals and renders the recovery apparatus easily transportable to allow convenient field servicing of refrigeration systems.

11 Claims, 5 Drawing Sheets

APPARATUS FOR RECOVERING REFRIGERANT WITH OFFSET CAM

This is a divisional application of application Ser. No. 07/778,734 filed Oct. 18, 1991 (now abandoned) which is a continuation-in-part of application Ser. No. 07/551,936 filed Jul. 12, 1990 (now abandoned) which is a divisional application of application Ser. No. 07/474,925 filed Feb. 2, 1990, now U.S. Pat. No. 4,981,020.

TECHNICAL FIELD

The present invention pertains to the art of refrigeration systems.

BACKGROUND OF THE INVENTION

In view of global concern regarding the environmental consequences attending the release of chlorofluorocarbon refrigerants into the atmosphere, there is now world-wide agreement regarding regulation of the production and use of chlorofluorocarbons. As a result of this regulation the cost of chlorofluorocarbon refrigerants is expected to rise dramatically.

Accordingly, there has arisen an interest in recovering refrigerant fluids. Commonly assigned U.S. Pat. No. 4,766,733, the disclosure of which is incorporated herein by reference, describes an apparatus for recovering chlorofluorocarbon refrigerants.

The need to provide field service for refrigeration equipment requires that refrigerant recovery devices be readily portable, e.g. so that a service person may transport the recovery device from his vehicle to a rooftop air conditioning unit without undue time and effort.

Known portable CFC recovery units include a conventional refrigerant compressor for transferring refrigerant from an apparatus, e.g. a refrigeration unit, to a receiver, e.g. a pressure vessel. The use of a conventional refrigerant compressor in a portable CFC recovery unit has several drawbacks.

The ease of portability of a particular portable CFC recovery unit depends, to a large extent, upon the weight of the unit. A conventional ½ HP refrigerant compressor weights about 40 pounds and accounts for a significant portion of the overall weight, i.e. between about 70 lb and about 100 lb, of a typical recovery unit.

The difficulties associated with using conventional refrigerant compressors in a portable CFC recovery unit are acknowleged by the industry, see e.g. "The Perfect HCFC Recovery Machine" by J. Wheeler, Contracting Business. October 1990, page 7, and "'Don't Wait To Buy Recyclers' MFRS Tell HVAC Contractors" by Peter Powell, The Air Conditioning, Heating and Refrigeration News, Oct. 7, 1991.

Furthermore, conventional refrigerant compressors are designed to operate on a closed loop wherein lubricant is carried in the refrigerant and is continuously cycled through the system. In an open loop refrigerant recovery system lubricant is not returned to the compressor potentially resulting in insufficient lubrication and premature wear of the compressor. This problem is aggravated by the need to pull a vacuum on the unit from which the refrigerant is being recovered. Furthermore, the lubricant in the refrigerant being recovered may include contaminants, e.g. hydrochloric acid and/or hydrofluoric acid, which may damage the compressor.

SUMMARY OF THE INVENTION

A lightweight, i.e. about 30 lb, apparatus for recovering a compressible refrigeration fluid from a refrigeration system and delivering the recovered fluid to a refrigerant receiver is described herein.

The recovery apparatus includes a lightweight, i.e. about 10 lb, refrigerant compressor for transferring refrigerant. The compressor includes a tubular cylinder wall, a cylinder head enclosing one end of the cylinder wall and defining an intake port and an outlet port, and valve means for controlling flow through the intake and outlet ports. A piston is slidably received within the cylinder wall and provided with self lubricating bidirectional annular seal means for sealing between the piston and cylinder wall. The compressor further includes means for reciprocally moving the piston within the cylinder wall to provide an intake stroke and an outlet stroke. The self lubricating feature of the compressor of the present invention avoids the problems of oil loss, oil contamination and associated compressor damage as well as eliminating the need for an oil separator. The bidirectional seal feature allows the compressor of the present invention to provide a vacuum intake stroke and thereby completely empty a system of used refrigerant.

In a preferred embodiment, the cylinder wall comprises hardened steel and the inner diametral surface of the cylinder wall is honed to a finish between about 2 microns and about 16 microns.

In a preferred embodiment, the piston comprises aluminum or an aluminum alloy.

In a preferred embodiment, the means for reciprocally moving comprises an electric motor, a crankarm operatively associated with the electric motor and a connecting rod operatively associated with the crankarm and with the piston. The crankarm is mounted on an input shaft and the crankarm and motor are operatively associated by reduction means for coupling the motor and the shaft.

In a particularly preferred embodiment the motor comprises an open frame universal Class A electric motor having an operating speed range of about 8,000 rpm to about 25,000 rpm, the reduction gear means provides a reduction between about 4:1 and about 6:1 and the shaft and crankarm operate in the range of about 2,000 rpm to about 4,000 rpm. Compared to the motor a conventional compressor, the motor of the compressor of the present invention is very lightweight, but runs at a relatively high speed. The reduction means of the compressor of the present invention allow use of the lightweight high speed motor by reducing the speed of the input shaft so that the piston and cylinder assembly of the compressor of the present invention operates in a range within which self lubricating piston seals may be employed.

In a particularly preferred embodiment, the piston is laterally displaced, toward the compression side, relative to the crankarm such that an extension of the centerline of the piston is laterally displaced from the center of rotation of the crankarm. The lateral displacement of the piston relative to the center of rotation of the crankarm dramatically reduces piston seal wear and thereby prolongs the service life of the corresponding embodiment of the compressor of the present invention.

Each of the embodiments of the bidirectional seal of the compressor of the present invention allow operation at relatively high speed, i.e. between about 2,000 rpm and 4,000 rpm, at elevated pressure, i.e. about 400 psig, while exposed to a variety of refrigerants and associated contaminants.

In a preferred embodiment, the piston defines a first annular groove and a pair of peripheral annular grooves. The peripheral grooves are spaced apart from and disposed on opposite sides for the first annular groove. An annular seal is disposed in the first annular groove and elastomeric means are disposed in the first groove between the piston and the annular seal for urging the annular seal toward the cylinder wall. Guide rings are disposed in each of the respective peripheral grooves for maintaining the piston in a parallel orientation relative to the cylinder wall.

In a particularly preferred embodiment, the annular seal comprises a carbon filled PTFE matrix composite material, the guide rings comprise a graphite filled PTFE matrix composite material and the elastomeric means comprises a ring of chlorosulfonated elastomer, a polychloroprene elastomer, a perfluorinated elastomer or an EPDM elastomer.

In an alternative preferred embodiment, the piston defines a pair of annular grooves and the seal means includes a first unidirectional annual seal, disposed in one of said grooves, for sealing between the piston and cylinder wall to provide a vacuum intake stroke and a second unidirectional seal, disposed in the other of said annular grooves, for sealing between the piston and cylinder to provide a high pressure outlet stroke.

DETAILED DESCRIPTION OF THE INVENTION

Figure 1:
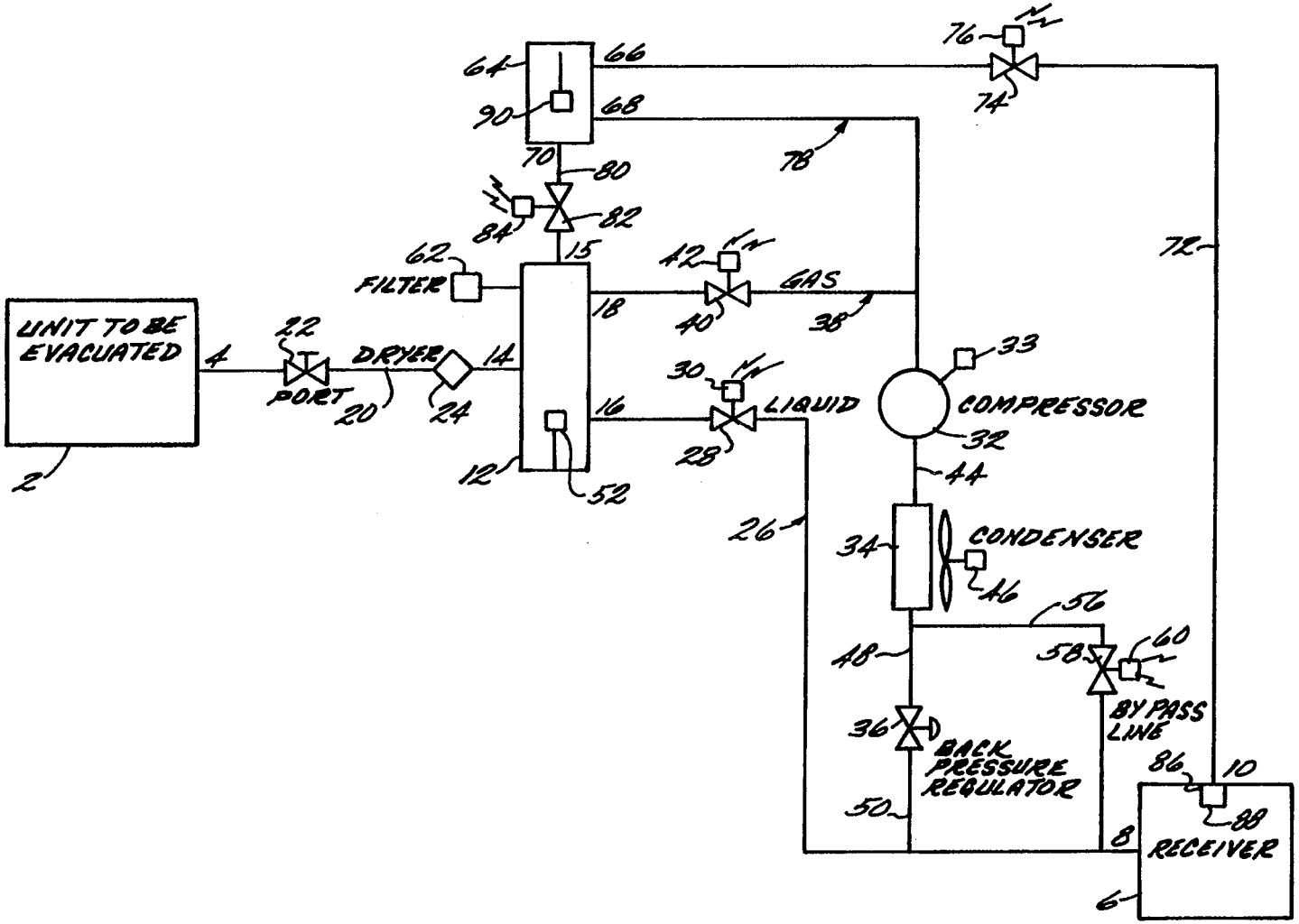
FIG. 1 shows a schematic diagram of the apparatus of the present invention.

The apparatus of the present invention allows recovery of a compressible refrigeration fluid from a refrigeration system 2 and delivery of the recovered fluid to a refrigerant receiver 6. The refrigeration system includes a port 4, the receiver includes first port 8 and second port 10.

The apparatus of the present invention includes a discriminator chamber 12. The discriminator chamber 12 includes an inlet port 14, a liquid inlet port 15, a liquid outlet port 16, and a gas outlet port 18. Conduit 20 provides a fluid flow connection between refrigeration system port 4 and inlet port 14 of the discriminator chamber 12. A valve 22 allows control of flow through conduit 20 and a filter dryer 24 allows removal of moisture and particulate contaminants from the refrigerant removed from the refrigeration system 2. A conduit 26 is provided for directing liquid phase refrigeration fluid from port 16 of discriminator chamber 12 to port 8 of receiver 6. Conduit 26 is provided with a solenoid valve 28 for controlling flow through conduit 26 and an actuator 30 opening and closing solenoid valve 28.

The apparatus of the present invention includes a compressor 32, a condensor 34 and a back pressure regulator 36 for condensing gas phase refrigerant fluid and providing a low pressure stream of substantially liquid phase fluid to conduit 26. Conduit 38 allows gas phase refrigerant fluid to flow from port 18 of discriminator chamber 12 to compressor 32. Conduit 38 is provided with a solenoid valve 40 for controlling flow through conduit 38. An actuator 42 is provided for opening and closing valve 40. Conduit 44 establishes a fluid flow connection between compressor 32 and condensor 34. Fan 46 provides a flow of air for removing heat from between the condenser 34 and the back pressure regulator 36. Conduit 50 establishes a fluid flow connection between back pressure regulator 36 and conduit 26.

Figure 3:
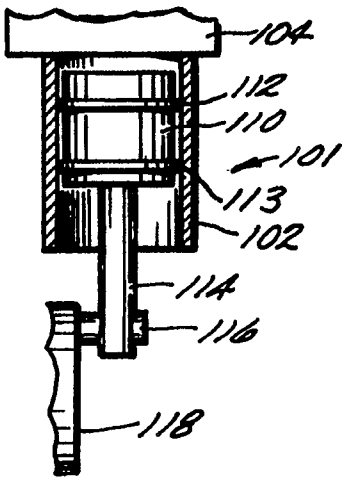
FIG. 3 shows a cross sectional view of a portion of the compressor of the present invention.
Figure 2:
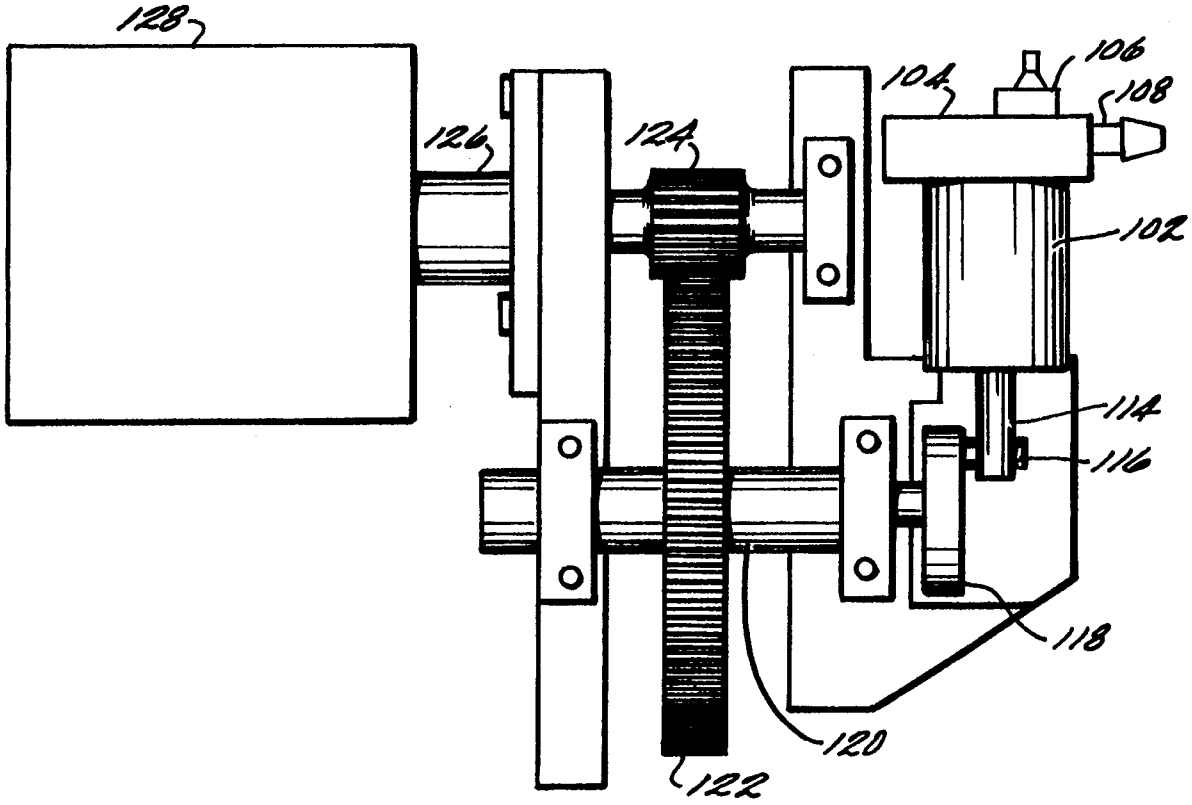
FIG. 2 shows a schematic top view of the compressor of the present invention.

The compressor 32 may comprise a conventional refrigerant compressor or a compressor of the present invention. Referring to FIGS. 2 and 3, a compressor 32' of the present invention includes a piston/cylinder/cylinder head assembly 101 having a a tubular cylinder wall 102. The tubular cylinder wall 102 may comprise, e.g. steel or stainless steel. Preferably, the cylinder wall 102 comprises hardened steel. Most preferably, the cylinder wall 102 comprises A2 steel, hardened to Rockwell C60–65. Preferably, the inner diametral surface of the cylinder wall 102 is honed to a very smooth finish, e.g. a 2 to 16 micron finish, to reduce wear on the piston seals (discussed further below) and reduce leakage. The cylinder head 104 encloses one end of the tubular cylinder wall 102. The cylinder head 104 is provided with an intake port 106 and an outlet port 108 as well as an intake valve and outlet valve (not shown) for controlling flow through intake port 106 and outlet port 108. A piston 110 is slidably received within the tubular cylinder wall 102. Preferably, the compressor, housing, piston 110 and head 104 are each made from aluminum or a light-weight metal alloy.

An annular seal 112 circumscribes the piston. Annular seal 112 is a bidirectional self lubricating annular seal for sealing between the piston 110 and tubular cylinder wall 102 so that the apparatus of the present invention provides a high pressure outlet stroke and a vacuum intake stroke. A piston ring 113 is provided to maintain piston 110 axially aligned within the tubular wall 102. A piston rod 114 is provided for reciprocally moving the piston within the tubular cylinder wall 102. The piston rod 114 is rotatably mounted on wrist pin 116. Wrist pin 116 is secured to the end of crankarm 118. Shaft 120 is provide for rotating crankarm 118. Gears 122 and 124 couple shaft 120 with the output shaft 126 of motor 128.

Preferably, motor 128 is an open frame Universal Class A electric motor having an operating speed between about 8,000 and about 25,000 rpm. The gears 122 and 124 are selected to provide shaft 120 with an operating range of about 2,000 to 4,000 rpm, i.e. provide a reduction of from about 4:1 to about 6:1 relative to the operating range of the motor 128.

Significantly, operation of the piston and cylinder of the compressor of the present invention at speeds of 2,000 to 4,000 rpm places unusually high demands on the self-lubricating bidirectional seals of the compressor of the present invention, due to the elevated temperatures, e.g. 300° F. to 500° F., generated by friction between the piston seals and the cylinder wall and to the potential for accelerated wear of the seal materials and associated reduction in service life of the seals. The piston seal embodiments described below each provide a long service life, e.g. at least 500 hours of operation, in the high speed, high pressure, high temperature, chemically hostile environment of the compressor of the present invention.

Figure 4:
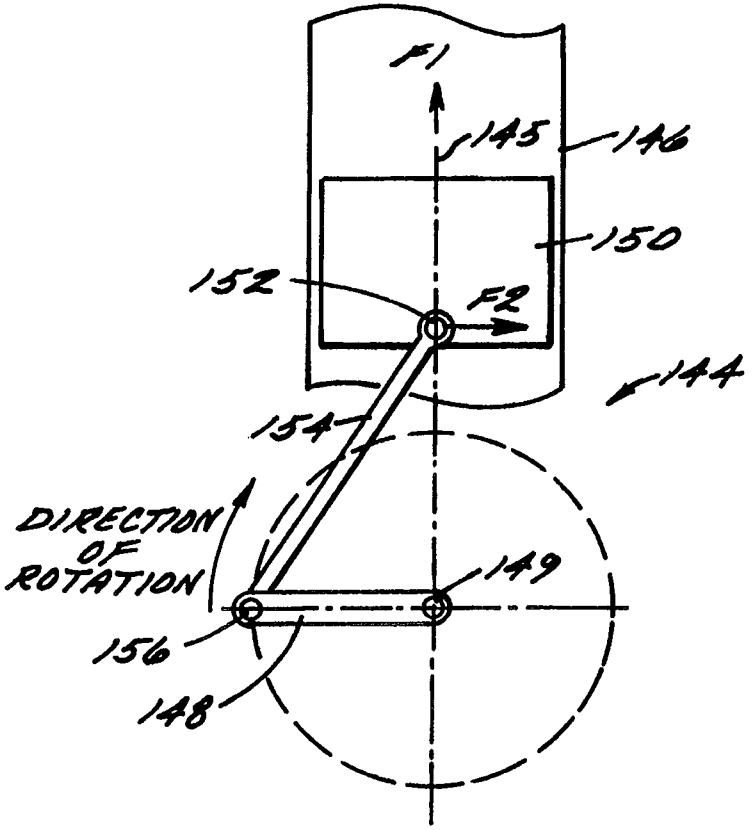
FIG. 4 shows a schematic drawing of a portion of an embodiment of a compressor according to the present invention.

FIG. 4 shows a schematic diagram of a first piston and cylinder arrangement 144 wherein the cylinder 146 is oriented so that an extension of the centerline 145 of the cylinder 146 and piston 150 passes through the center of rotation 149 of the crankarm 148. The circle swept out by rotation of the crankarm 148 is shown by the dashed line in FIG. 4. Piston 150 is slidably received within the cylinder 146 and is connected to crankarm 148 by wrist pin 152, connecting rod 154 and crank pin 156. The piston and cylinder arrangement 144 is shown in the middle of the compression stroke. As the crankarm 148 is further rotated in the direction indicated, the compression stroke, i.e. upward displacement of piston 150, continues until the end of the crankarm 148 reaches the top center position and crank arm 148 is aligned with the centerline of the piston 146. The force acting on the piston 146 during the compression stroke may be separated into two components, i.e. the upwardly directed compressive force F1 and the side force F2, directed perpendicularly to the compressive force.

In embodiments of the present invention in which the piston and cylinder arrangement corresponds to that shown in FIG. 4, it has been found that the wear pattern of the seals (described below) of the piston 110 of the present invention corresponds to the direction of the side force F2, i.e. the seals wear more quickly on the side of the piston subjected to the side force F2.

Figure 5:
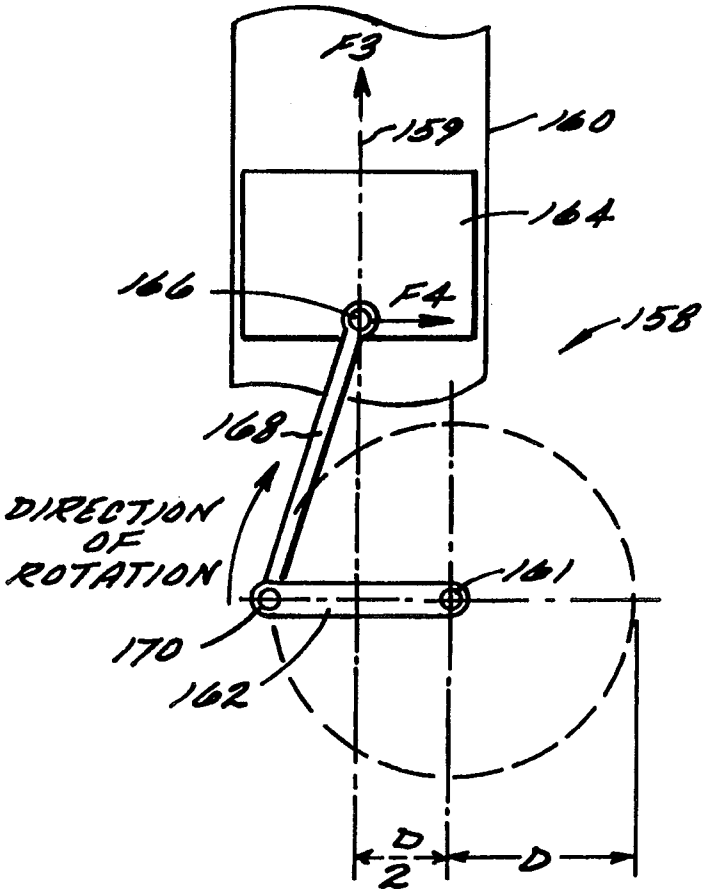
FIG. 5 shows a schematic drawing of a portion of an alternative embodiment of a compressor according to the present invention.

A preferred embodiment of the piston and cylinder arrangement 158 of the compressor of the present invention is shown in FIG. 5. In piston and cylinder arrangement 158 the centerline 159 of the cylinder 160 and piston 164 is laterally displaced from the center of rotation 161 of the crankarm 162. Preferably, the centerline of the cylinder 160 is displaced from the center of rotation 161 of crankarm 162 by a distance equal to about one half of the diameter (D) of circle swept out by rotation of the crankarm 162. Piston 164 is slidably received in cylinder 160 and connected to crankarm 162 by wrist pin 166, connecting rod 168 and crank pin 170.

The piston and cylinder arrangement 158 is shown in the middle of the compression stroke. Further rotation of crankarm 162 continues the compression stroke until crank pin 170 reaches the top center position on crankarm 162 in a manner similar to that discussed above in regard to FIG. 4. Unlike the embodiment shown in FIG. 4, the top center position on the crank arm 162 is not aligned with the centerline of cylinder 160 and wrist pin 170 crosses the centerline of cylinder 160 as it sweeps from the piston shown in FIG. 5 to the top center position on crankarm 162.

The forces acting on piston 164 may be separated into two components; i.e. upwardly directed compressive force F3 and side force F4, directed perpendicularly to compressive force F3. The inventors have calculated that, other factors being equal, the preferred embodiment of FIG. 5 provides several advantages over the embodiment shown in FIG. 4, i.e.:

while compressive force F3 is slightly reduced, i.e. F3 is about 3% less than F1, the side force F4 is dramatically reduced, i.e. F4 is about 50% less than F2;

the reduced magnitude of side force F4 results in a corresponding reduction of the side force on piston seals and should effectively avoid the pattern of premature side force related wear observed with regard to the seal on piston 164;

the reduced magnitude of side force F4 results in reduced loads on wrist pins 166 and 170, thereby prolonging bearing life;

the required power input to crankshaft 162 during the compression stroke is reduced by about 8%; and the reduced magnitude of side force F4 results in a dramatic reduction, i.e. about 400% of friction between the piston and cylinder.

The combination of the above advantageous results should dramatically prolong the service life of the compressor shown in FIG. 5.

Figure 6:
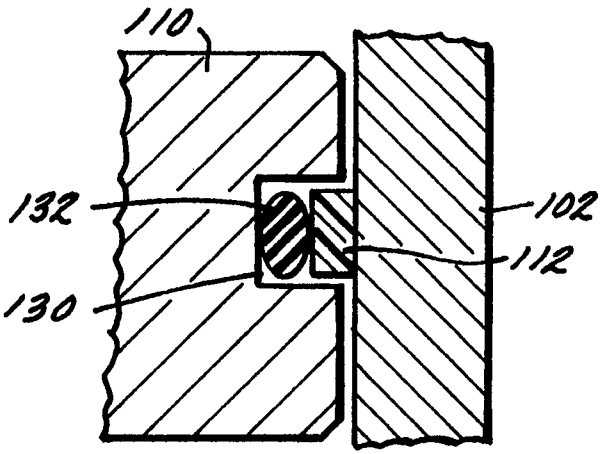
FIG. 6 shows a cross sectional view of a portion of an embodiment of the compressor of the present invention.

FIG. 6 shows one embodiment of the self lubricating bidirectional annular seal of the compressor 32 of present invention. Piston 110 defines an annular groove 130 which circumscribes the piston. Annular seal 112 is disposed within groove 130. Preferably, the annular seal 112 comprises a graphite or carbon filled fluoropolymer, e.g. polytetrafluoroethylene. A chemical resistant elastomeric ring 132 urges piston ring 112 towards cylinder wall 102 to provide a bidirectional seal. Preferably, the elastomeric ring 132 comprises a chlorosulfonated polyethylene elastomer, a polychloroprene elastomer, a perfluorinated elastomer or an ethylene propylene diene (EPDM) elastomer.

Figure 7:
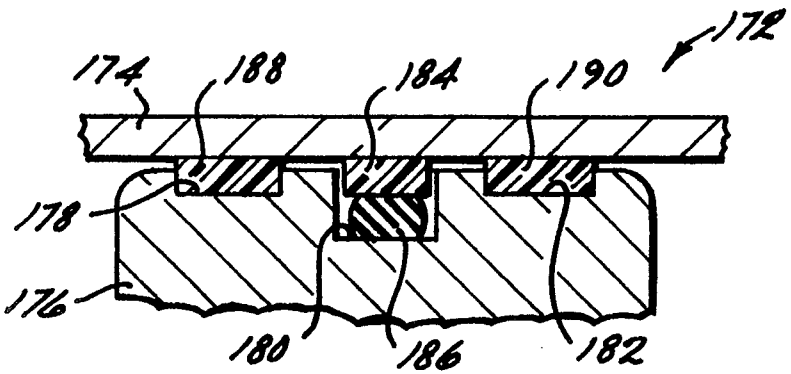
FIG. 7 shows a cross sectional view of a portion of a second embodiment of the compressor of the present invention.

A schematic cross sectional view of a portion of a alternative embodiment 172 of the self lubricating bidirectional annular seal of the compressor 32 of the present invention is shown in FIG. 7. The embodiment 172 includes a cylinder wall 174 and a piston 176. Piston 176 defines three spaced apart annular grooves 178, 180 182. Annular seal 184 is disposed in the central groove 180 and urged toward cylinder wall 174 by elastomeric ring 186 disposed in grooves 180 between annular seal 184 and piston 176. Guide rings 188, 190 for maintaining piston 176 in axial alignment with cylinder wall 174 are disposed in peripheral grooves 178, 182, respectively.

Preferably, the annular seal 184 and guide rings 188, 190 comprise a graphite or carbon filled fluoropolymer matrix composite material. Most preferably, annular seal 184 comprises a carbon filled polytetrafluoroethylene matrix material known as TURCITE® 109. Suitable seals may be obtained commercially, e.g. from W. S. Shamban Company of Fort Wayne, Ind. Most Preferably, the guide rings 188, 190 comprises a graphite filled polytetrafluoroethylene matrix material known as TURCITE® 51. Suitable wear rings may be obtained commercially, e.g. from W. S. Shamban Company.

The TURCITE® 109 material exhibits a tensile strength of 3000 psi and an elongation at break of 200% (each determined according to ASTM D 1457-81A), a specific gravity of 2.10 and a shore D hardness of 60–65. The TURCITE® 51 material exhibits a tensile strength of 1800 psi and an elongation at break of 100% (each determined according to ASTM D 1457-81A), a specific gravity of 2.06 and a shore D hardness of 63.

Preferably, elastomeric ring 186 comprises a CFC resistant, oil resistant and contaminant, e.g. HF or HCL, resistant, elastomer having good temperature resistance, i.e. is stable at temperatures in the rang of 300° F. to 400° F. Suitable materials include perfluorinated elastomers, chlorosulfonated polyethylene elastomers, a polychloroprene elastomers and ethylene propylene diene elastomers. Most preferably, the elastomeric ring 186 comprises an elastomer known as TUREL® EGA. Suitable elastomeric rings may be obtained commercially, e.g. from W. S. Shamban. It should be noted that the choice of elastomer potentially limits the applicability of the compressor, since a single choice of elastomer cannot offer optimal resistance to all CFCS.

Figure 8:
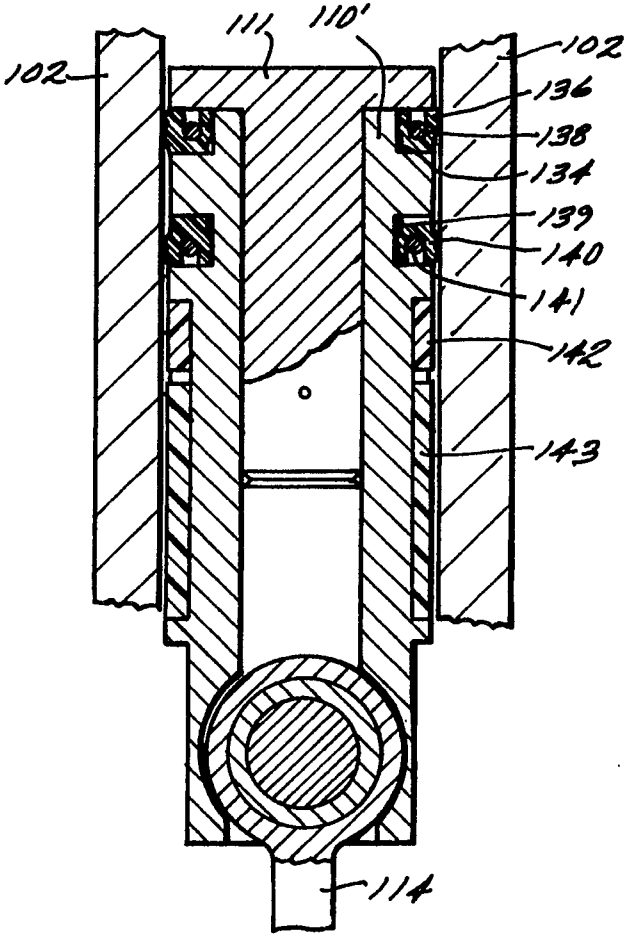
FIG. 8 shows a cross sectional view of a portion a third embodiment of the compressor of the present invention.

A schematic cross sectional view of another alternative embodiment of the self lubricating bidirectional annular seal of compressor 32 that offers broad based applicability is shown in FIG. 8 in which piston body 110' and piston cap 111 sealingly connected to piston body 110' are slidably received within tubular cylinder wall 102 and in which two annular grooves 134, 139 circumscribe piston body 110'. A pair of chemically resistant unidirectional seals 136 and 140 are disposed in the grooves 134, 139, respectively. In the preferred embodiment shown, the seals 136, 140 are "U-cup" type seals, each defining an annular groove therein. Helical springs 138, 141 disposed within the respective annular grooves of seals 136, 140, urge the seals 136, 140 radially outwardly toward the tubular cylinder wall 102. A pair of guide rings 142, 143, for maintaining the piston body 110' in axial alignment with the cylinder wall 102, surround piston 110'.

Preferably, seals 136, 140 each comprise a fluoropolymer. More preferably, each of the unidirectional seals 136, 140 comprise a glass filled fluoropolymer matrix composite material. Most preferably, U-cup seals 136, 140 comprise a material known as TURCITE® 404. The TURCITE®404 material is a glass and molybdenum filled polytetrafluoroethylene having a tensile strength of about 3500 psi (ASTM D638), an elongation at break of about 230% (ASTM D638), a shore D hardness of about 55 (ASTM D2240) and a specific gravity of 2.18 (ASTM D792).

Preferably, springs 138, 141 each comprises stainless steel. Most preferably, the springs 138, 141 each comprise 302 stainless steel.

Suitable U-cup seal and spring assemblies are commercially available, e.g. from American Variseal of Broomfield, Colo.

Preferably, guide rings 142, 143 comprise a graphite filled polytetrafluoroethylene matrix material. Most preferably, guide rings 142, 143 comprise the TURCITE® 51 material described above.

Figure 9:
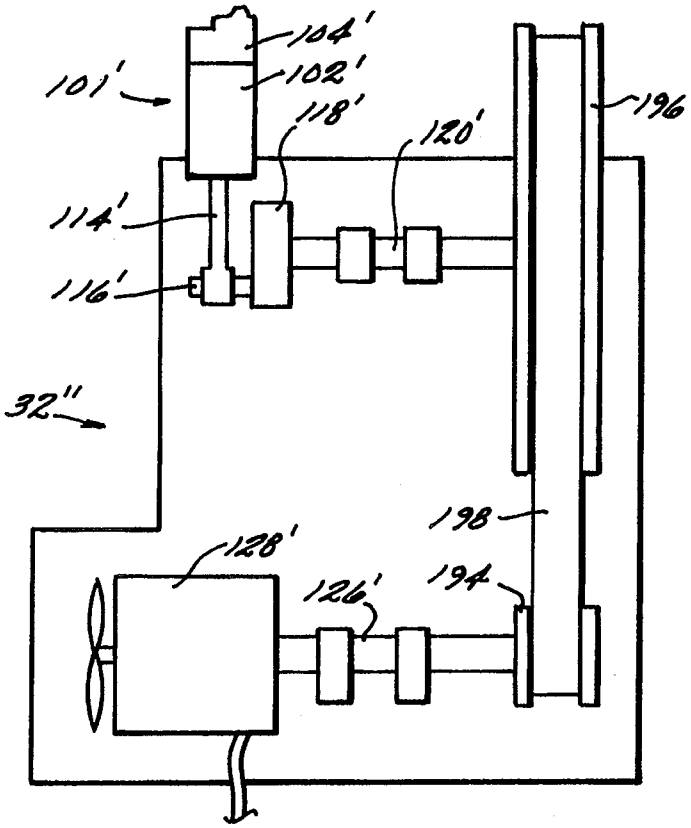
FIG. 9 shows a schematic diagram of an alternative embodiment of the compressor of the present invention.

An alternative embodiment 32" of the compressor of the present invention is shown in FIG. 9. The compressor 32" includes a motor 128', a rotatably mounted output shaft 126', a rotatably mounted input shaft 120', a crankarm 118', a piston rod 114' and a piston/cylinder/cylinder head assembly 101' and is analogous to compressor 32' shown in FIGS. 2 with the exception that pulleys 194, 196 and belt 198 have been substituted for gears 122, 124 as a means for transmitting power from shaft 126' to shaft 120'. The belt driven compressor is more cost effective than the gear driven embodiment and, while requiring maintenance more frequently than the gear driven embodiment, is easier and less expensive to repair. The belt driven embodiment is also quieter and exhibits less vibration than the gear driven embodiment of FIG. 2.

Referring again to FIG. 1, valve 28 is normally closed and valve 40 is normally open. The discriminator chamber 12 includes float sensor 52 for sensing the level of liquid phase refrigerant fluid in the discriminator chamber 12. Sensor 52 is responsive to the level of liquid phase refrigerant fluid in the discrimination chamber 12 and provides a control signal if the discriminator chamber 12 is full of liquid phase refrigerant fluid. Actuators 30 and 42 are responsive to the control signal provided by sensor 52. In response to the control signal, actuator 42 closes valve 40 to prevent liquid from flowing from the discriminator chamber 12 to the compressor 32 and opens valve 28 to allow the liquid to drain from the discriminator chamber 12 through conduit 26 to receiver 6.

A bypass conduit 56 is provided to allow fluid to flow directly from condenser 34 to inlet port 8 of receiver 6. The bypass conduit 56 is provided with a solenoid valve 58 for controlling flow through conduit 56. An actuator 60 is provided to open and close solenoid valve 58. Valve 58 is normally closed. A pressure sensor 62 is responsive to the pressure within discriminator chamber 12 and provides a control signal if the pressure in discriminator chamber 12 falls below a predetermined value. Actuator 60 is responsive to the control signal from pressure sensor 62 and opens valve 58 in response to the control signal.

The recovery apparatus of the present invention includes a safety chamber 64. Safety chamber 64 includes an inlet port 66, a gas outlet port 68 and a liquid outlet port 70. A conduit 72 is provided for allowing fluid flow between port 10 of receiver 6 and inlet port 66 of safety chamber 64. Conduit 72 is provided with a solenoid valve 74 for controlling flow through conduit 72. An actuator 76 is provided for opening and closing solenoid valve 74. Conduit 78 allows fluid to flow from gas exit port 68 of safety chamber 64 to conduit 38 and on to compressor 32. Conduit 80 is provided with a solenoid valve 82 for controlling flow through conduit 80. An actuator 84 is provided for opening and closing solenoid valve 82.

Inlet tube 86 extends into receiver 6 through port 10 of receiver 6 to an open end 88.

If the level of liquid phase refrigerant within receiver 6 is below the open end 88 of inlet tube 86, gas phase refrigerant fluid flows through conduit 72, safety chamber 64 and conduit 78 to compressor 32.

As the receiver fills with refrigeration fluid, the liquid level rises until the liquid level reaches the end 88 of inlet tube 86. Once the liquid level in the receiver is at the level of the open end 88 of inlet tube 86, the introduction of additional refrigeration fluid into receiver 6 will result in liquid phase refrigerant being forced through conduit 72 and into inlet port 66 of safety chamber 64. Sensor 90 within safety chamber 64 is responsive to liquid level within safety chamber 64. When liquid phase refrigerant enters safety chamber 64, sensor 90 provides a control signal. Actuators 30, 42, and 76 and switch 33 are responsive to sensor 90 and close valves 28, 40 and 74 and cut power to the compressor 32, respectively, in response to the control signal from sensor 90.

The apparatus of the present invention has two modes of operation and may be used to recover refrigeration fluid from a refrigeration system (recovery mode) and to charge refrigeration fluid from receiver to a refrigeration system (charging mode).

In the recovery mode compressor 32 and condensor fan 46 are turned on. Compressor 32 lowers the pressure in receiver 6 as well as compressing the influent stream 38 of gas phase fluid. Fluid evaporates from the receiver 6 is directed through conduit 72, inlet 66, chamber 64, outlet 68, conduit 78 and is combined with influent gas stream 38. Evaporation of refrigerant fluid from receiver 6 lowers the temperature of the liquid phase fluid remaining in receiver 6. The apparatus maintains a pressure differential to drive fluid from refrigeration unit 2 to receiver 6 until substantially all refrigerant has been removed from the refrigeration unit.

In the charging mode, the compressor 32 is turned on, fan 46 is turned off, back pressure regulator 36 is closed and valve 58 is open. Fluid is evaporated from the receiver and compressed in the compressor 32 to form a high pressure elevated temperature stream of refrigerant fluid. The high pressure elevated temperature stream of refrigerant is introduced to the receiver 6 through conduit 26 to increase the pressure within receiver 6 and force fluid from receiver 6 through a conduit (not shown) to the refrigeration system 2 being charged.

The discrimination chamber of the present invention allows liquid phase refrigerant to bypass the compressor, condensor and back pressure regulator as it passes from the refrigeration unit to the refrigerant receiver and thereby allow refrigerant to be removed for the refrigeration unit in significantly less time than possible with the apparatus described in U.S. Pat. No. 4,766,733.

Conventional refrigerant receivers are provided with a safety valve in order to preclude the generation of internal pressures within a refrigerant receiver that exceed the pressure rating of the container. The safety valve opens at a predetermined maximum pressure that is below the maximum pressure rating of the receiver. In order to avoid generating internal pressures with a receiver that would trigger the safety valve, the amount of refrigerant introduced to a receiver must be controlled. Conventional, refrigerant containers are filled by weight. In the contest of recovering refrigerant from refrigeration units in the field, a weighting apparatus constitutes a cumbersome additional piece of equipment to transport. The safety chamber of the present invention allows control of the amount of refrigerant introduced to the receiver without requiring any equipment in addition to the apparatus of the present invention.

The features of the compressor of the present invention offer several benefits which are particularly advantageous in the context of refrigerant recovery.

Conventional refrigeration compressors are typically heavy, e.g. typically about 40 lb, cumbersome devices which include a thick cast iron cylinder wall. The compressor of the present invention is lightweight, i.e. about 10 lb, and easily portable, thereby making a lightweight, i.e. on the order of 30 lb, and easily portable refrigerant recovery unit feasible.

Typically the materials of construction of conventional refrigerant compressors are not resistant to impurities, e.g. acids, present in used refrigerant fluids. The compressor of the present invention is adapted for transferring contaminated refrigerants.

Conventional refrigeration compressors operate in closed loop refrigeration systems in which a lubricating oil migrates through the loop and continuously lubricates the compressor. The recovery of used refrigerant is inherently an open loop process. Each time the used refrigerant passes from the refrigeration system through the compressor into a receiver lubricating oil would be washed out of the compressor. The refrigerant compressor of the present invention is self lubricating, i.e. oilless, thereby eliminating the need for an oil separator and the additional weight associated therewith and avoiding problems of oil loss, oil contamination and associated damage to the compressor.

Conventional refrigerant compressors include unidirectional seals and are unable to provide a vacuum intake stroke. The seals on the piston of the refrigerant compressor of the present invention are bidirectional and the refrigerant compressor of the present invention can thereof be used to pull the inlet pressure below atmospheric pressure, and allow a refrigerant system to be completely emptied of used refrigerant.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for compressing a gas phase refrigerant comprising:
   - a tubular cylinder wall extending from a first end to a second end;
   - a cylinder head enclosing the second end of the cylinder wall and defining an intake port and an outlet port;
   - valve means for controlling flow through the intake port and the outlet port;
   - a piston slidably received with the cylinder wall for reciprocating movement, said piston being rotationally symmetrical about a centerline and axially aligned with said cylinder wall for reciprocating movement;
   - a first annular groove circumscribing said piston;
   - self-lubricating bidirectional annular seal means disposed in said first annular groove for sealing between the piston and the cylinder wall; and,
   - means for reciprocally moving the piston axially within the tubular cylinder wall to provide an intake stroke and an outlet stroke, said means including an electric motor, a crankarm having a center of rotation and being operatively associated with said electric motor, said piston being laterally displaced toward the compression side relative to the center of rotation of the crankarm such that an extension of the centerline of said piston is laterally displaced from the center of rotation of the crankarm.

2. The apparatus of claim 1, wherein the annular seal comprises a fluoropolymer.

3. The apparatus of claim 2, wherein the annular seal comprises a carbon particle filled polytetrafluoroethylene matrix composite material.

4. The apparatus of claim 1, wherein the piston further includes a pair of peripheral annular grooves, spaced apart from and disposed on opposite sides of the first annular groove, and the apparatus further comprises a pair of guide rings, wherein one of said guide rings is disposed in each of said peripheral grooves to maintain said piston in axial alignment with said cylinder wall.

5. The apparatus of claim 4, wherein the guide rings comprise a graphite filled polytetrafluoroethylene matrix composite material.

6. The apparatus of claim 1, wherein the piston is connected to the connecting rod by a wrist pin, the crankarm sweeps out a circular operating path, having a diameter equal to the distance between the center of rotation of the crankarm and the wrist pin and the piston is displaced so that the centerline of the piston is laterally displaced from the center of rotation of the crankarm by a distance corresponding to one half of the diameter of the circular operating path swept out by the crankarm.

7. The apparatus of claim 1 wherein elastomeric means is disposed within the annular groove between the piston and annular seal for urging the annular seal toward the cylinder wall.

8. The apparatus of claim 7, wherein the elastomeric means comprises ring formed from a chlorosulfonated polyethylene elastomer or polychloroprene elastomer, a perfluorinated elastomer or an ethylene-propylenediene elastomer.

9. An apparatus for compressing a gas phase refrigerant comprising:

a tubular cylinder wall extending from a first end to a second end;

a cylinder head enclosing the second end of the cylinder and defining an intake port and an outlet port;

valve means for controlling flow through the intake port and the outlet port;

a piston slidably received with the cylinder wall for reciprocating movement, said piston being rotationally symmetrical about a centerline and axially aligned with said cylinder wall;

first and second annular grooves circumscribing said piston;

a self-lubricating unidirectional annular seal disposed in said first annular groove for sealing between said piston and said cylinder wall to provide a vacuum intake stroke;

a self-lubricating unidirectional annular seal disposed in said second annular groove for sealing between the piston and the cylinder wall to provide a high pressure outlet stroke; and means for reciprocally moving the piston axially within the tubular cylinder wall to provide an intake stroke and an outlet stroke, said means including an electric motor, a crankarm having a center of rotation and being operatively associated with said electric motor, said piston being laterally displaced towards the compression side relative to the center of rotation of the crankarm such that extension of the centerline of said piston is laterally displaced from the center of rotation of the crankarm.

10. The device of claim 9, wherein each of the unidirectional seals comprises a seal ring having an annular groove defined therein and a helical metal spring within the annular groove.

11. The device of claim 10, wherein the seal ring comprises a glass filled fluoropolymer matrix material and the helical metal spring comprises stainless steel.

* * * * *